US009476174B2

(12) United States Patent
Patterson

(10) Patent No.: US 9,476,174 B2
(45) Date of Patent: Oct. 25, 2016

(54) PORTABLE PERIMETER WARNING INDICATION SYSTEM

(71) Applicant: Phase 2 Enterprises LLC, Katy, TX (US)

(72) Inventor: James Patterson, Katy, TX (US)

( * ) Notice: Subject to any disclaimer, the term of this patent is extended or adjusted under 35 U.S.C. 154(b) by 104 days.

(21) Appl. No.: 14/519,344

(22) Filed: Oct. 21, 2014

(65) Prior Publication Data

US 2016/0111033 A1 Apr. 21, 2016

(51) Int. Cl.
*E01F 13/02* (2006.01)

(52) U.S. Cl.
CPC ..... *E01F 13/028* (2013.01); *E01F 9/688* (2016.02)

(58) Field of Classification Search
CPC ..... E01F 13/02; E01F 13/028; E01F 9/688
USPC ..... 116/63 R, 63 P; 256/45; 40/514, 515
See application file for complete search history.

(56) References Cited

U.S. PATENT DOCUMENTS 3,056,495 A * 10/1962 Malachowski ..... B60Q 7/005 116/63 P
3,742,897 A * 7/1973 Meek et al. ..... B60Q 7/005 116/63 P
4,531,472 A * 7/1985 Marrero et al. ..... E01F 13/046 116/28 R
4,844,420 A * 7/1989 Oster ..... B65H 75/38 160/24
5,551,370 A * 9/1996 Hwang ..... E01F 9/688 116/63 P
5,775,253 A * 7/1998 Quan et al. ..... E01F 9/688 116/63 P
6,119,621 A 9/2000 Johnson
6,508,195 B1 * 1/2003 Tipaldo ..... B60Q 7/00 116/63 P
6,595,496 B1 * 7/2003 Langlie et al. ..... A01K 3/00 256/1
7,007,420 B2 * 3/2006 Garcia ..... G09F 7/22 116/63 P
7,258,506 B2 * 8/2007 Tipaldo ..... E01F 9/688 116/63 P
7,261,051 B2 * 8/2007 Tipaldo ..... E01F 9/012 116/63 P (Continued)

FOREIGN PATENT DOCUMENTS

EP 1143072 A1 * 10/2001 ..... G09F 7/00
JP 2011052410 A * 3/2011 ..... E01F 13/02
WO WO 9907944 A1 * 2/1999 ..... B60Q 7/00

OTHER PUBLICATIONS

International Search Report and Written Opinion in related International patent application No. PCT/US2015/055809, mailed Jan. 6, 2016, 7 pages.

(Continued)

*Primary Examiner* — R. A. Smith
(74) *Attorney, Agent, or Firm* — Law Office of Jeff Williams; J. Oliver Williams

(57) ABSTRACT

A portable perimeter warning indication system configured for denoting the safety status of neighboring areas. The system includes a base member and a telescoping pole. The base member operates between a closed and open position. The telescoping pole is in selective communication with the base member and contains a strap housing. The telescoping pole is configured to extend and locate the strap housing at a particular height. The strap housing includes a retractable strap configured to indicate a perimeter between two or more points. The strap visually indicates the individual safety status of each area on either side of the strap.

15 Claims, 4 Drawing Sheets

(56) References Cited

U.S. PATENT DOCUMENTS

| | | | | |
|---|---|---|---|---|
| 7,275,888 | B1 * | 10/2007 | Christensen et al. ... | E01F 13/02 404/6 |
| 7,538,688 | B1 | 5/2009 | Stewart | |
| 8,256,985 | B2 * | 9/2012 | Ashmead ..... | E01F 13/02 404/6 |
| 2005/0017115 | A1 | 1/2005 | de Lorenzo | |
| 2005/0087732 | A1 | 4/2005 | Short | |
| 2008/0299358 | A1 * | 12/2008 | Kuchar ..... | E01F 13/028 428/203 |
| 2010/0044661 | A1 | 2/2010 | Weiner | |
| 2010/0090184 | A1 | 4/2010 | Manning | |
| 2012/0119907 | A1 | 5/2012 | Teuchert | |
| 2014/0077021 | A1 | 3/2014 | Beemsterboer et al. | |
| 2015/0137057 | A1 * | 5/2015 | Weiner ..... | E01F 13/028 256/40 |

OTHER PUBLICATIONS

Presco. "Adapt Double Sided Barricade Tape from Presco", Jun. 3, 2014. [Retrieved on Nov. 22, 2015]. Retrieved from the Internet: http://www.presco.com/adapt-double-sided-barricade-tape-from-presco/.

* cited by examiner

PORTABLE PERIMETER WARNING INDICATION SYSTEM

BACKGROUND

1. Field of the Invention

The present application relates generally to caution and warning devices and, more particularly, to an adjustable and portable warning indication system.

2. Description of Related Art

A perimeter is typically erected around areas which are designed or intended to have restricted access. Perimeters may prevent access completely or may be used to merely notify an individual that a particular area is not to be entered. Examples may include a fence or rolled crime scene tape. Fences are typically more permanent while "tape" is more portable. Although tape is simple and heavily used as a portable perimeter, disadvantages remain.

Tape generally provides a single warning or message related to the predefined area. For example, the tape may say "caution" or "do not enter". This message is placed on both sides of the tape to ensure that the individuals see the message independent of tape orientation. However, the tape fails to precisely indicate which area adjacent either side of the tape is the restricted or danger area. Confusion is readily seen in close quarters or where multiple areas are defined in close proximity. Additionally, tape is not easily reusable. The tape is cut or broken off from the main role to a particular length. The tape is not suited for reuse to different lengths (i.e. making it longer). Without an adequate perimeter warning indication system to accurately identify to individuals the proper status of either side of the perimeter, confusion may result. Unauthorized access and injuries are only a few of the dangers that can come from failed perimeter systems.

It is desirable to provide a perimeter warning indication system that is portable, adjustable, and clearly identifies the status of opposing areas adjacent the perimeter. Although great strides have been made, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
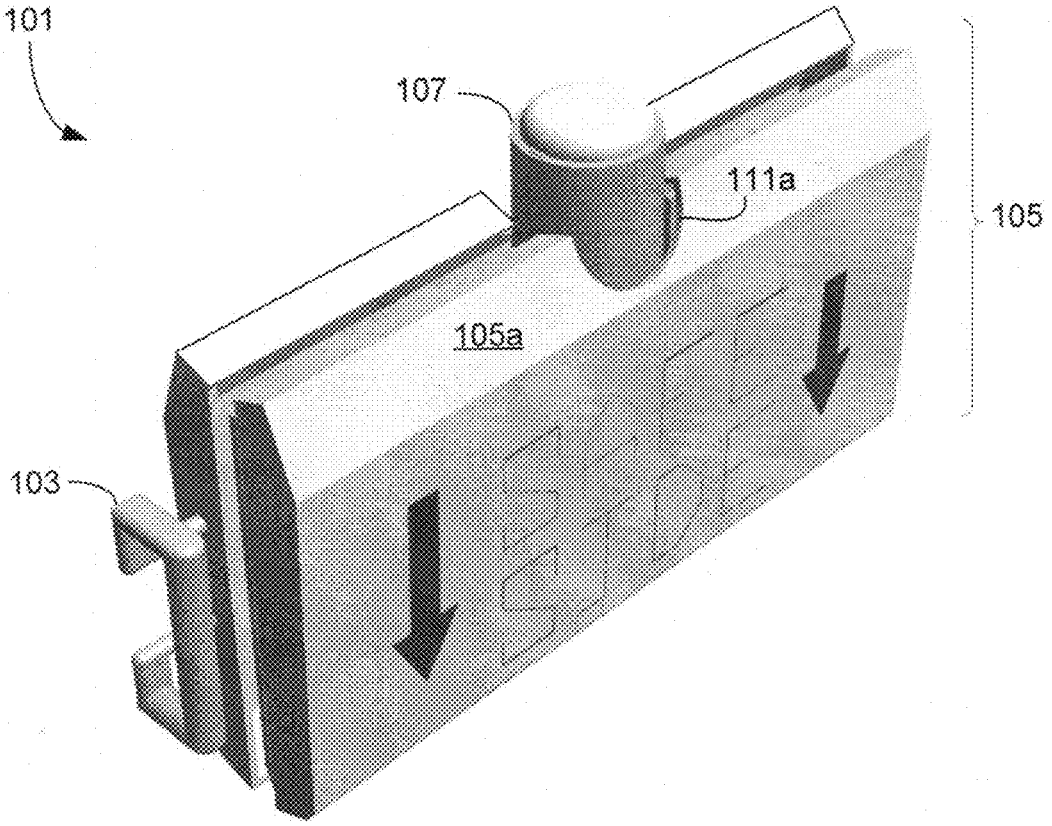
FIG. 1 is a perspective view of a portable perimeter warning indication system according to the preferred embodiment of the present application.

While the system and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The system and method of use in accordance with the present application overcomes one or more of the above-discussed problems commonly associated with perimeter defining devices. Specifically, the system of the present application is configured to denote the safety status of two distinct areas on either side of a portable perimeter. These and other unique features of the system are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The portable perimeter warning indication system is illustrated in the associated drawings. The system includes a portable and collapsible base member that can be oriented and located on a plurality of surfaces. A telescoping pole is also included. The telescoping pole releasably couples to the base and selectively elongates to locate one or more strap housings at an appropriate height above ground level. The strap housing includes one or more straps having a visual indicator. Each strap is selectively retractable and extendable from within the strap housing and is configured to releasably couple to a remote object. The strap therein indicates a perimeter between a first area and a second area when extended. The strap denotes the safety status of each area when viewed. Because the straps are retractable and can extend to various lengths, the system is highly adapted for reuse and adjustment to various locations.

Referring now to the drawings wherein like reference characters identify corresponding or similar elements in form and function throughout the several views. FIG. 1 illustrates the portable perimeter warning indication system 101 in a collapsed and portable form. The portability of system 101 increases the ease of travel and storage. A handle 103 is located at one end to permit a user to grasp and move system 101. As noted above, system 101 includes a base 105 and a telescoping pole 107. As seen in FIG. 1, base 105 is in a collapsed and folded orientation wherein base 105 is configured to form an outer shell to carry and protect pole 107 and the other elements within system 101 during transportation and storage. The various elements of system 101 are configured to nest within base 105.

Figure 3:
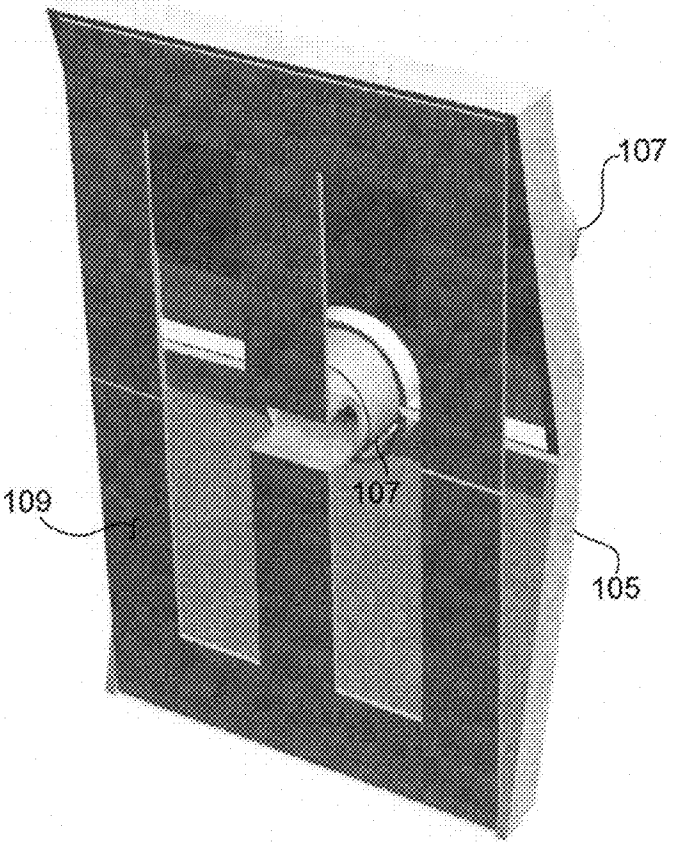
FIGS. 2 and 3 are assorted perspective views of a fully expanded base and pole used in the portable perimeter warning indication system of FIG. 1.
Figure 2:
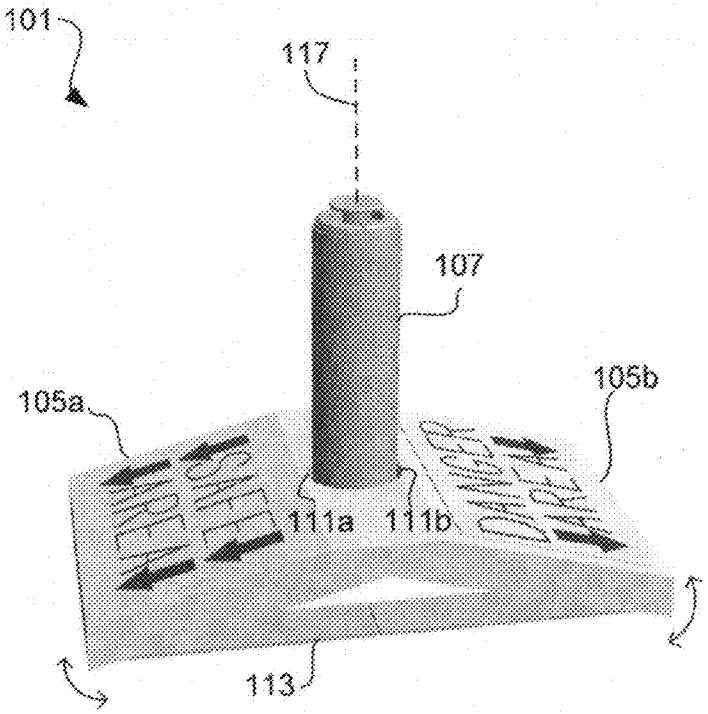

Referring now also to FIGS. 2 and 3 in the drawings, the relationship between base member 105 and pole 107 are illustrated when base 105 is positioned in an open orientation. Contained within base 105 is all the elements needed to produce a fully operational perimeter configured to denote the safety status of at least two opposing areas. Base 105 is configured to "unfold" or open and form a base structure. FIG. 2 illustrates a perspective side view of base 105 and FIG. 3 is a perspective bottom view of base 105. Base member 105 includes lower surface member 113 having a bottom surface 109 for contacting a suitable surface, such as earth, concrete, subflooring, etc.

Base 105 has two sides 105*a*, 105*b* which have opposing and corresponding cutouts 111*a*, 111*b* that are configured to permit pole 107 to pass through base 105 and releasably engage lower surface member 113. A lower portion of pole 107 is configured to snap or press into lower surface member 113, being secured by interference fit. Lower surface member 113 orients pole 107 in a relatively vertical orientation. Cutouts 111*a* and 111*b* together act as upper guides to assist in maintaining the vertical orientation of pole 107 as an upper portion of pole 107 is subjected to external and internal forces. It is appreciated that pole 107 has a central axis 117. Although pole 107 is oriented relatively vertical to that of bottom surface 109, pole may be configured in some embodiments to be coupled to lower surface member 113 in plurality of radial orientations about central axis 117. A user may selectively orient pole 107 between a first radial orientation and a second radial orientation.

Figure 4:
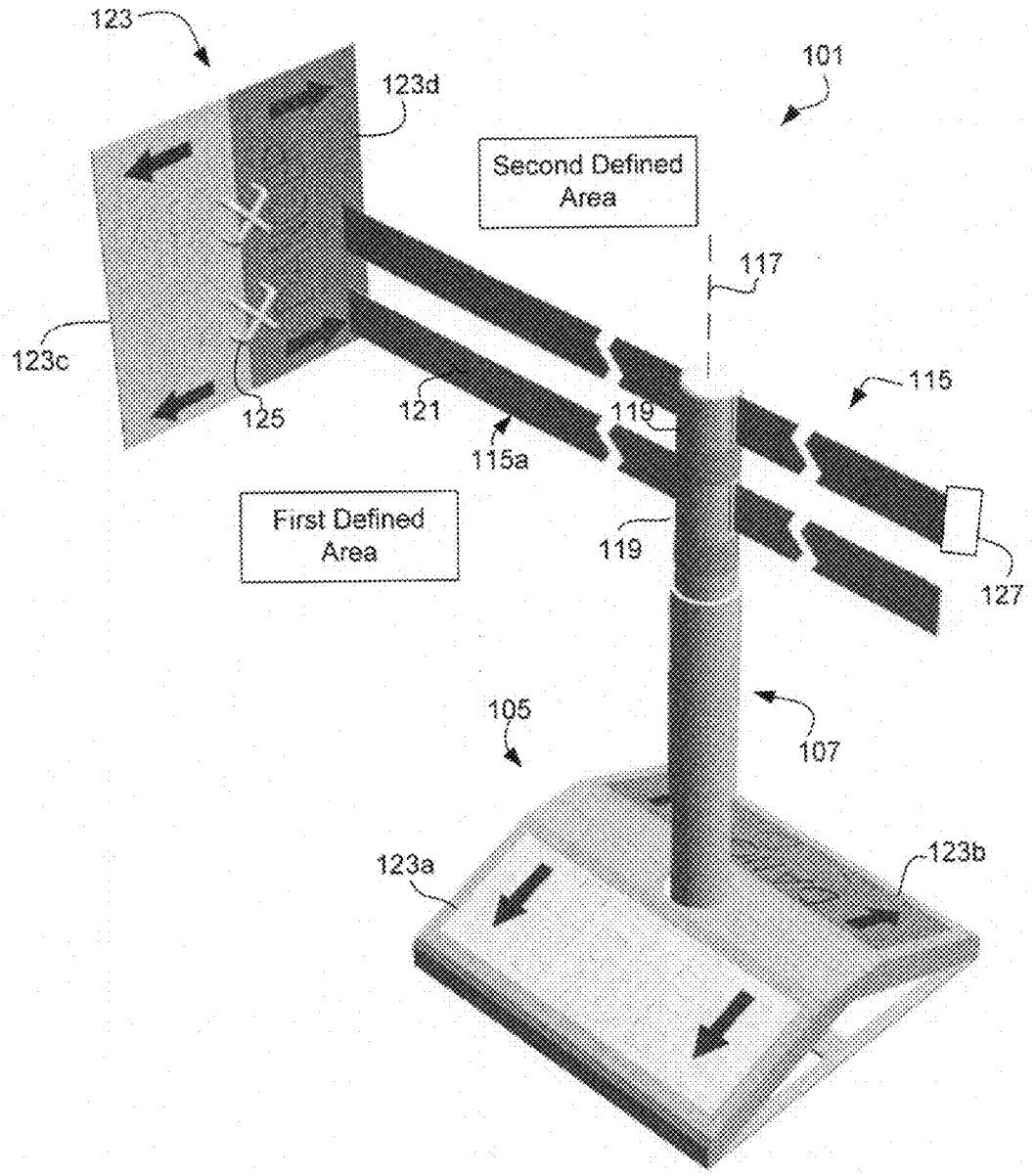
FIG. 4 is a fully expanded perspective view of the portable perimeter warning indication system of FIG. 1.

Referring now also to FIG. 4 in the drawings, system 101 is illustrated in use with the straps 115 extended. System 101 includes straps 115 to divide a single area into two or more adjacent areas. In doing this, straps 115 act as the perimeter or border. As seen in FIG. 4, straps 115 indicate a perimeter between a first defined area and a second defined area. Straps 115 are configured to selectively extend and retract within a strap housing 119 coupled to telescoping pole 107. It is appreciated that system 101 may include one or more straps 115 and strap housings 119. Although four (4) straps are illustrated, it is understood that one or more straps 115 may be used.

Each strap 115 has opposing sides, each side facing a predefined area. At least one of the straps 115 includes a visual indicator. A visual indicator can be at least any of a color, pattern, tag, textual script, numbering, and so forth to represent or symbolize the safety status of the viewing area. For example, strap 115*a* has a side 121. Side 121 is visible from the first defined area. Side 121 may include a visual indicator to represent the safety status of the first defined area. Likewise, the side opposite side 121 may also include a visual indicator to represent the safety status to anyone viewing strap 115*a* from the second defined viewing area. Visual indicators on each side of strap 115*a* may be independent of one another. By having separate visual indicators on opposing sides of straps 115, individuals within each area can readily and easily determine the safety status of their particular area.

Additional visual indicators may also be included within system 101. System 101 may include a sign 123*a-d* to supplement or replace the visual indicators associated with straps 115. Signs 123 are similar to that of straps 115 in that signs 123 are also used to denote the safety status of a particular defined area. Signs 123 may be located either on base 105 or may be located on a remote structure (i.e. wall, housing, pipe . . . ) or object. When located on a remote object, sign 123 is preferred to be located at an identical height to that of straps 115. However, it is understood that heights may vary.

System 101 may further include a detachable hook 125. Hook 125 is configured to releasably attach directly to a remote object, structure, or sign 123 as shown. Both hook 125 and signs 123 are configured to be detachable and reusable to one or more surfaces. A method of attachment may include a magnetic surface so as to attach to metallic structures or objects. Other methods of attachment may include the use of an adhesive. Other types of releasable devices or substances are contemplated.

It is known that not all areas can be designated in a single straight line. In order to accommodate perimeters of various shapes, system 101 is configured to permit the isolated and individual rotation of strap housing 119 relative to pole 107. Strap housing 119 is optionally configured to rotate between two or more radial orientations about central axis 117. If multiple strap housings are used, each strap housing may be independently rotational relative to other strap housings. This permits a single pole to extend straps in two or more directions.

Figure 5:
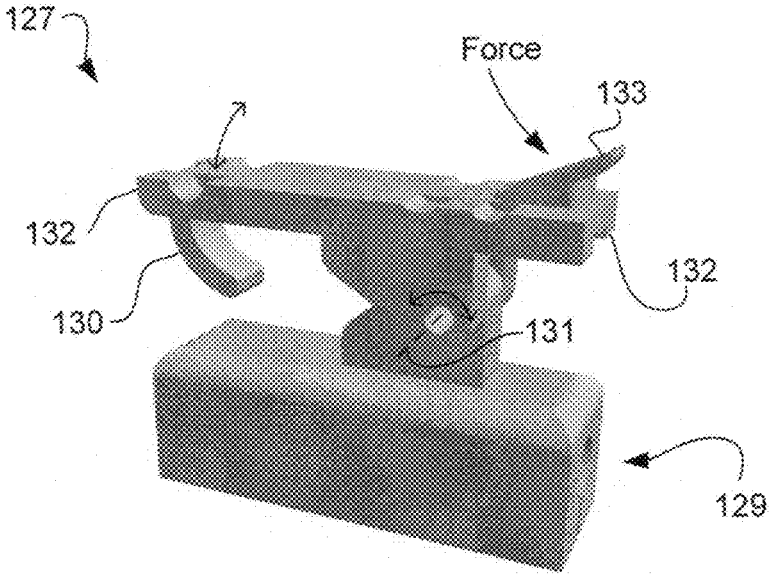
FIG. 5 is a perspective view of a latch used in the portable perimeter warning indication system of FIG. 1.

Referring now also to FIG. 5 in the drawings, a latch is illustrated. Latch 127 is configured to be selectively attached to an end of a strap 115. Strap 115 may engage a base portion 129 of latch 127. Latch includes an arm 130 configured to engage an object in sufficiently so as to maintain the tension and position of strap 115 when extended from strap housing 119. Latch 127 further includes side members 132 located either side of arm 130. The object being engaged by arm 130 may be at least any of the following: another pole 107, hook 125, a secondary strap, or another object. In the preferred embodiment, arm 130 and side members 132 are pivotable as a unit about an axis 131, thereby permitting radial movement of arm 130 relative to base portion 129. Furthermore, arm 130 is configured to be individually rotatable about axis 131. Arm 130 may selectively incur radial movement relative to side members 132 as a force is applied to pad 133.

Figure 6:
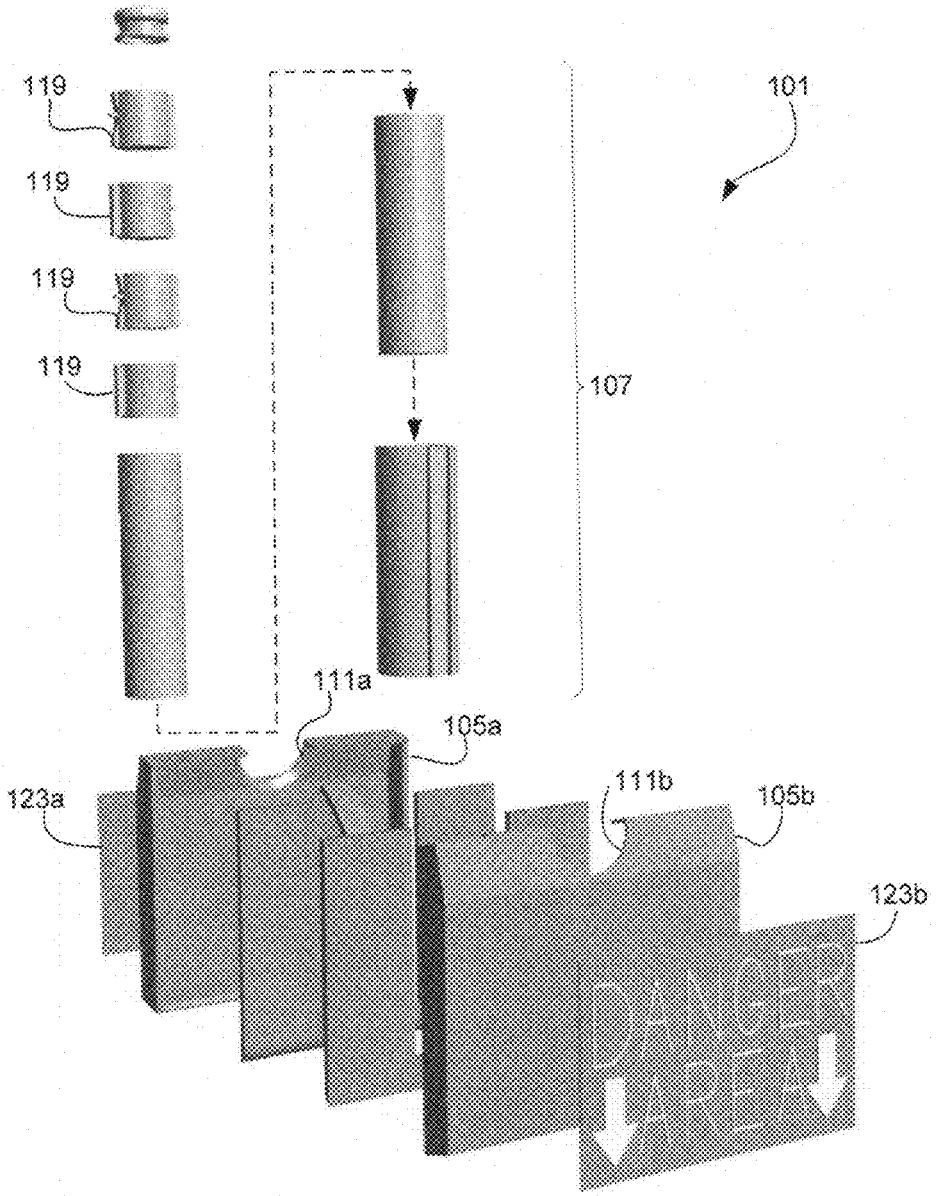
FIG. 6 is a partial exploded view of the portable perimeter warning indication system of FIG. 1.

Referring now also to FIG. 6 in the drawings, a partial exploded view of system 101 is illustrated. As more clearly seen in FIG. 6, pole 107 is composed of a plurality of elongated and relatively cylindrical members which are configured to translate relative to one another along axis 117. Strap housings 119 are illustrated as being in communication with pole 107. Each strap housing 119 is independently operable from neighboring strap housings 119.

As alluded to above, system 101 is configured to operate with one or more similar systems of the same type as system 101. In other words, system 101 includes base 105, pole 107, and one or more strap housings 119 with associated straps 115. A series of systems 101 may be selectively aligned to form intricately designed and expansive perimeters. Signs 123*a-b* may be selectively used along with signs 123*c-d* where appropriate. Straps 115 from one system 101 may be coupled to a pole from a neighboring system 101.

The current application has many advantages over the prior art including at least the following: (1) visual indicators used to denote the safety status of separate and distinct areas; (2) ability to collapse for transportation and storage; (3) self-contained system; (4) ability to extend a plurality of straps in different radial orientations relative to a common axis; (5) detachable latches; and (6) optional signs to correspond to visual indicators in designating the safety status of a particular defined area.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A perimeter warning indication system, comprising:

a base having a plurality of hinged sides configured to selectively open and close, the base having a lower surface;

a telescoping pole in communication with the base, the telescoping pole having a length selectively adjustable by a user; and a strap housing having a strap configured to extend from and retract within the strap housing, the strap being configured to indicate a perimeter between a first area and a second area when extended; the strap housing in communication with the telescoping pole;

wherein the strap denotes the safety status of each area; and wherein the base is configured to close around the telescoping pole and the strap housing for transportation when in a closed orientation, the lower surface being internal to the base in a closed orientation and exposed in contact with a suitable surface when in an open orientation so as to support and stabilize the telescoping pole.

2. The perimeter warning indication system of claim 1, wherein the base is configured to collapse to permit the transportation and storage of the telescoping pole, the strap housing, and the strap.

3. The perimeter warning indication system of claim 2, wherein the telescoping pole and strap housing nest within the base when collapsed.

4. The perimeter warning indication system of claim 1, wherein the telescoping pole is detachable from the base.

5. The perimeter warning indication system of claim 1, wherein the strap adjustably extends and retracts from the strap housing to accommodate re-use within different locations.

6. The perimeter warning indication system of claim 1, wherein the strap has a first side visible from the first area and a second side visible from a second area, each side is configured to visually indicate the safety status of a particular area.

7. The perimeter warning indication system of claim 1, wherein the strap housing rotates relative to an axis of the telescoping pole to allow the strap to extend in a plurality of radial directions from a central axis.

8. The perimeter warning indication system of claim 1, further comprising:

a latch configured to secure a first end of the strap to an object remote from the telescoping pole.

9. The perimeter warning indication system of claim 8, wherein the latch is detachable from the strap.

10. The perimeter warning indication system of claim 1, further comprising:

a sign indicating the safety status of at least one of the first area and the second area.

11. The perimeter warning indication system of claim 10, wherein the sign is coupled to the base.

12. The perimeter warning indication system of claim 10, wherein the sign includes a magnetic surface for attachment to a structure, the sign being releasable and reusable.

13. The perimeter warning indication system of claim 1, further comprising:

a detachable hook configured to couple to a remote object, the strap configured to releasably attach to the detachable hook.

14. The perimeter warning indication system of claim 13, wherein the detachable hook includes a magnetic surface.

15. The perimeter warning indication system of claim 1, further comprising:

a secondary pole, the strap from the telescoping pole configured to couple to the secondary pole.

* * * * *